US005982335A

United States Patent [19]

Faraone et al.

[11] Patent Number: 5,982,335

[45] Date of Patent: Nov. 9, 1999

[54] ANTENNA WITH LOW RELUCTANCE MATERIAL POSITIONED TO INFLUENCE RADIATION PATTERN

[75] Inventors: Antonio Faraone; Quirino Balzano, both of Plantation, Fla.

[73] Assignee: Motorola, Inc., Schaumburg, Ill.

[21] Appl. No.: 08/937,760

[22] Filed: Sep. 25, 1997

[51] Int. Cl.[6] ..... H01Q 1/00

[52] U.S. Cl. ..... 343/787; 343/700 MS; 343/846

[58] Field of Search ..... 343/787, 895, 343/700 MS, 702, 846

[56] References Cited

U.S. PATENT DOCUMENTS 3,811,128 5/1974 Munson ..... 343/787

4,697,192 9/1987 Hofer et al. ..... 343/895

4,879,562 11/1989 Stern et al. ..... 343/787

5,515,059 5/1996 How et al. ..... 342/372

*Primary Examiner*—Don Wong

*Assistant Examiner*—Hoang Nguyen

*Attorney, Agent, or Firm*—Andrew S. Fuller

[57] ABSTRACT

An antenna (100) has a low reluctance material (140) positioned to influence radiation pattern. The antenna (100) includes a radiator (110), and the low magnetic reluctance material (140) is positioned in close proximity to a particular side of the radiator (110). The low reluctance material (140) has a primary function of providing a preferred path for the magnetic field generated by the radiator (110), thus confining the magnetic energy and reducing radiation along at least one side of the antenna (100).

12 Claims, 3 Drawing Sheets

100

400

ANTENNA WITH LOW RELUCTANCE MATERIAL POSITIONED TO INFLUENCE RADIATION PATTERN

TECHNICAL FIELD

This invention relates in general to antennas, and more particularly, to diminutive antennas.

BACKGROUND

Planar, microstrip antennas have characteristics often sought for portable communication devices, including advantages in cost, efficiency, size, and weight. A planar antenna is typically formed by disposing a patch radiator on one side of a grounded dielectric substrate. So formed, the antenna is somewhat directional in that its radiation pattern is primarily directed outward from the patch radiator and away from the ground plane. However, some radiation inevitably spills around the ground plane in the opposite direction. This radiation flow is generally undesirable as the associated energy is often dissipated by absorptive materials that may be in close proximity. Such energy dissipation translates into a reduction of antenna efficiency.

Current trends demand a reduction in size, weight, and cost for portable communication devices. Smaller portable communication devices necessitates smaller antennas. Planar antennas show much promise in satisfying the need for antenna size, weight, and cost reduction. However, such smaller antennas are susceptible to efficiency losses from the close proximity of absorptive materials in and around the communication device. Accordingly, an improved design for antennas is needed.

DETAILED DESCRIPTION OF THE PREFERRED EMBODIMENT

The present invention provides for an antenna having low reluctance material positioned to influence radiation pattern. The antenna includes a radiator that generates an electromagnetic field, and a low magnetic reluctance material positioned in close proximity to a particular side of the radiator. The low magnetic reluctance material has a primary function of providing a preferred path for the magnetic field, thus confining the magnetic energy to reduce radiation along the particular side of the radiator. In the preferred embodiment, the radiator is disposed on a grounded dielectric substrate, and the low magnetic reluctance material positioned along the ground plane of the dielectric substrate.

Figure 1:
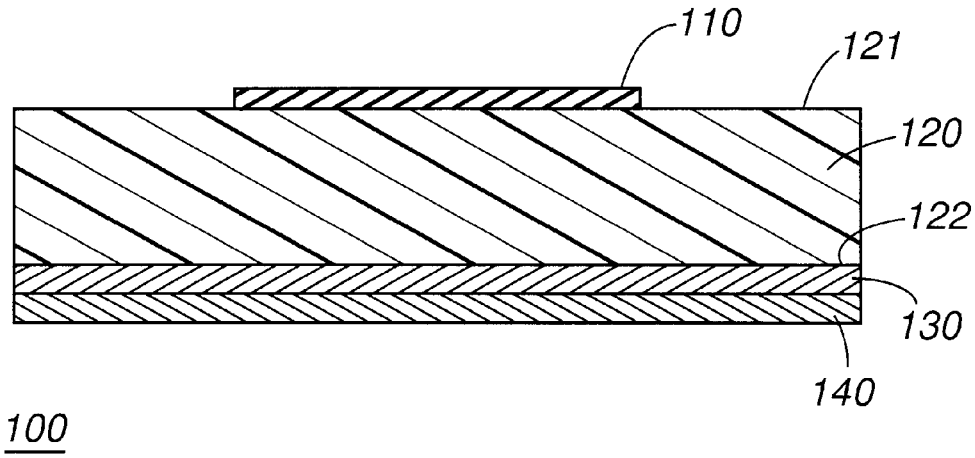
FIG. 1 is a cross-sectional view of a planar patch antenna, in accordance with the present invention.

FIG. 1 is a cross-sectional view of a planar patch antenna assembly 100, in accordance with the present invention. The planar patch antenna 100 comprises a radiating structure or radiator 110, a dielectric substrate 120, a ground plane 130, and a low magnetic reluctance material 140. In the preferred embodiment, the dielectric material is formed from an substrate which exhibits very low ohmic losses. The radiating structure 110 is preferably a planar conductor or microstrip printed or otherwise disposed along one side 121 of the dielectric substrate 120. The ground plane 130 is preferably formed from conductive material and is disposed on an opposing side 122 of the dielectric substrate. The low magnetic reluctance material 140 is disposed alongside the ground plane 130, and is preferably formed from a ferromagnetic material, or other high magnetic permeability material. The ferromagnetic material 140 is positioned, relative to the placement of the radiator, to limit or otherwise influence the pattern of radiation generated by the radiator as well as the near-field of the antenna itself. Preferably, the ferromagnetic material is positioned along a particular side of the radiator where no radiation is desired.

Figure 2:
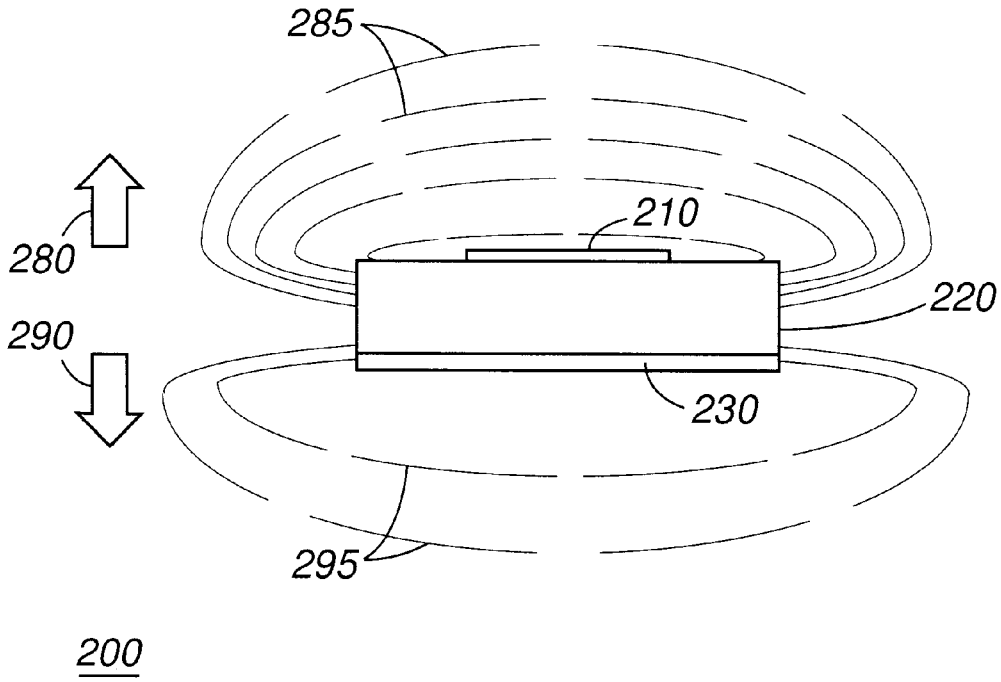
FIG. 2 ( PRIOR ART )
FIG. 2 is a diagram illustrating magnetic field distribution for a prior art antenna.

FIG. 2 is a diagram illustrating magnetic field distribution with respect to a cross-section of a prior art antenna 200. Generally, the antenna 200 is designed to have a patch radiator 210 and a ground plane 230 separated by dielectric material 220. The radiator 210 operates to emit radiation in a primary hemispherical pattern 280 emanating away from the ground plane. However, it is generally unavoidable that a portion of the radiation is delivered around the ground plane 230 in a secondary hemispherical pattern. This second hemispherical pattern 290 typically represents wasted energy that ultimately gets dissipated. This electromagnetic radiation pattern features a magnetic field distribution which is schematically illustrated using flux lines 285, 295.

Figure 3:
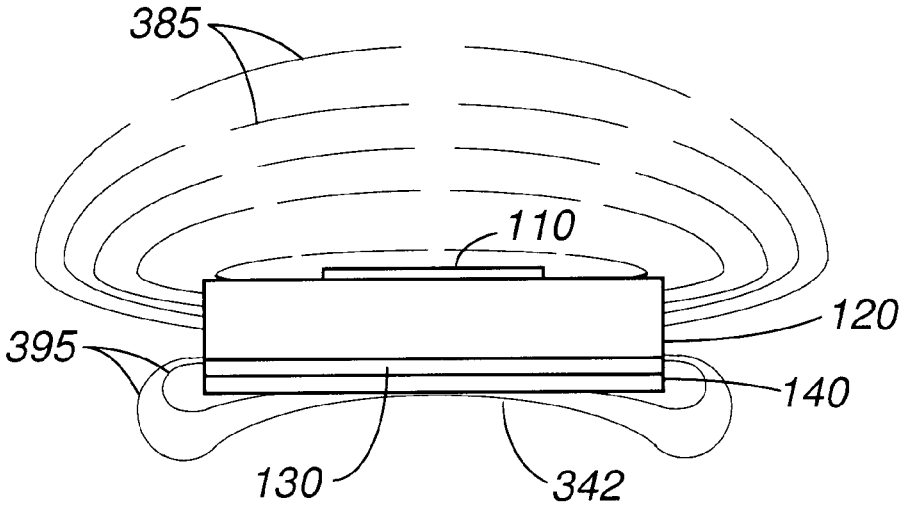
FIG. 3 is a diagram illustrating magnetic field distribution for an antenna in accordance with the present invention.

In the present invention, it is recognized that the overall radiation pattern may be influenced by modifying the magnetic field around the radiator. Accordingly, a high magnetic permeability/low reluctance material is incorporated into an antenna to limit radiation, where radiation is not desired. The high magnetic permeability material operates by affecting the magnetic field component of the electromagnetic radiation emanating from the radiator. FIG. 3 is a diagram illustrating the magnetic field distribution with respect to the antenna 100 of FIG. 1. The high magnetic permeability material operates to modify the magnetic field, schematically illustrated by flux lines 385, 395, about the antenna. Particularly, the high magnetic permeability material creates a low reluctance path that confines the magnetic field lines 395 along one side 342 of the antenna 100. This reduces the amount of magnetic energy and the resultant radiation about that portion of the antenna.

A planar antenna design is particularly suited for incorporating a low reluctance material as described. The low reluctance material is positioned in a region where the presence of the electromagnetic field is regarded as an undesired effect. Additionally, the presence of this material is unlikely to negatively impact the performance of the antenna, as the radiation pattern along the primary hemisphere remains substantially unaffected.

Figure 4:
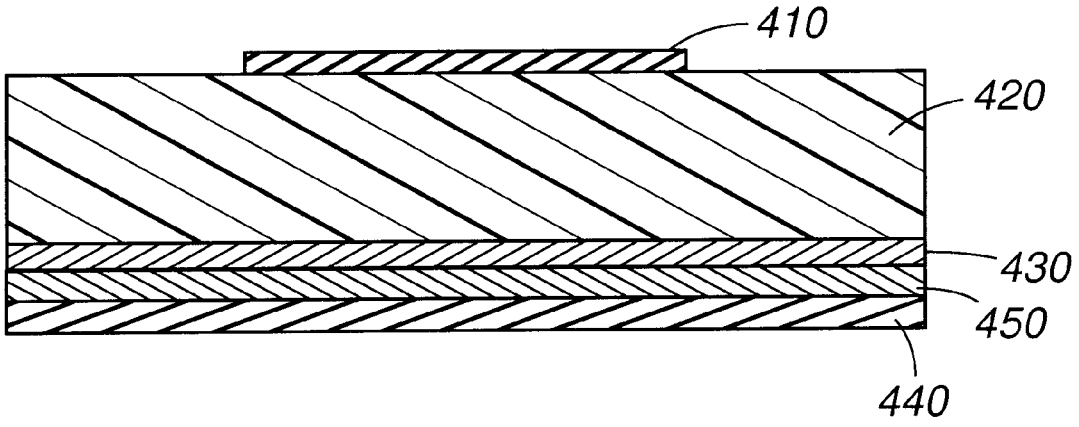
FIG. 4 is a cross-sectional view of a second embodiment of a planar patch antenna, in accordance with the present invention.

FIG. 4 is a cross-sectional view of a second embodiment of planar patch antenna 400, in accordance with the present invention. The planar patch antenna 400 comprises a radiating structure or radiator 410, a dielectric substrate 420, a ground plane 430, and a low magnetic reluctance material 440 as described with respect to FIG. 1. However, in this embodiment, a dissipative layer 450 is interposed between the ground plane 430 and the low reluctance material 440. This dissipative layer 450 is preferably formed from graphite paint or like materials which exhibit substantial ohmic losses. This layer of material 450 dissipates the energy associated with undesired currents induced in the back of the ground plane 430 by diffractive effects due to the finite size of the ground plane.

Figure 5:
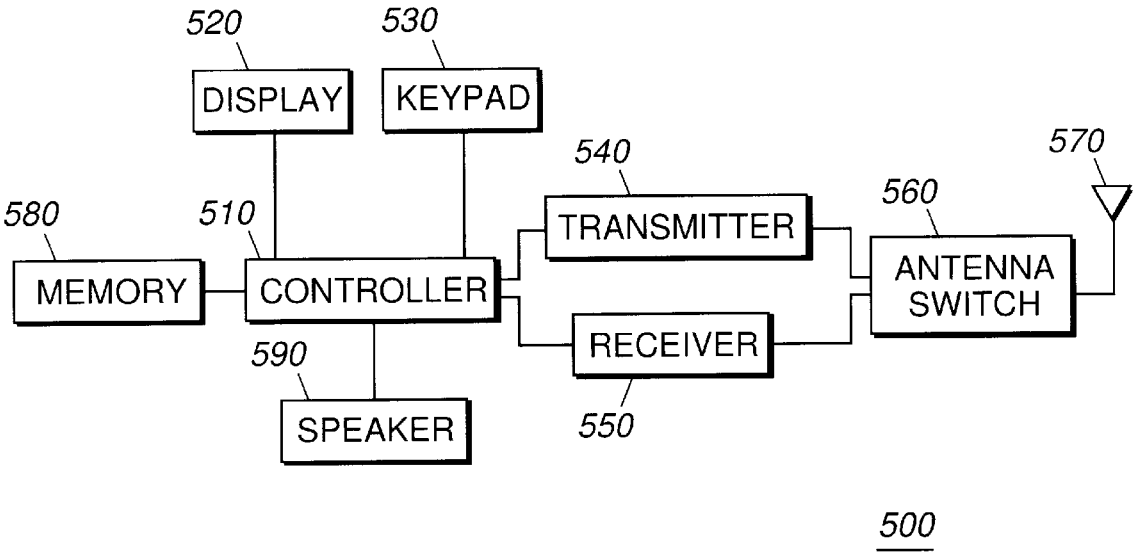
FIG. 5 is a block diagram of a radio communication device, in accordance with the present invention.

FIG. 5 shows a block diagram of a radio communication device 500, in accordance with the present invention. The communication device 500 is preferably a two-way radio or radio telephone that is operable to provide telephone interconnect, dispatch, paging, private call and data services. In the radio 500, a controller 510 is coupled to a memory 580, to a transmitter 540, and to a receiver 550, to provide communication circuitry. The transmitter 540 and the receiver 550 of the communication circuitry are coupled via an antenna switch 560 to an antenna 570 formed in accordance with the present invention. For transmit operations, the controller 510 configures the antenna switch to couple the transmitter 540 to the antenna 570. Similarly, for receive operations, the controller 510 couples the antenna 570 via the antenna switch 560 to the receiver 550. Receive and transmit operations are conducted under instructions stored in the memory 580. The radio 500 also includes a display 520, a keypad 530, and a speaker 590, that together provide a user interface for accessing radio functions.

The present invention provides significant advantages over the prior art. By positioning a low magnetic reluctance material in close proximity to a radiator to influence radiation pattern, directivity and efficiency of the antenna is enhanced. Additionally, localized energy dissipation in the area about the low reluctance material is reduced.

What is claimed is:

1. An antenna, comprising:

a radiator that generates an electromagnetic field;

a low magnetic reluctance material positioned in close proximity to the radiator along a particular side of the radiator, and having a primary function of confining the electromagnetic field to reduce radiation generated by the radiator along the particular side of the radiator;

a ground plane disposed between the low magnetic reluctance material and the radiator; and a dielectric substrate disposed between the radiator and the ground plane.

2. The antenna of claim 1, wherein the radiator comprises a planar conductor disposed on the dielectric substrate.

3. The antenna of claim 1, wherein the low magnetic reluctance material comprises a ferromagnetic material.

4. A planar antenna, comprising:

a ground plane having first and second sides opposite to each other;

a radiator disposed along the first side of the ground plane;

a dielectric substrate disposed between the radiator and the ground plane; and a low magnetic reluctance material disposed proximate to the ground plane along the second side.

5. The antenna of claim 4, wherein the radiator comprises a planar conductor printed on the dielectric substrate.

6. The antenna of claim 4, wherein the low magnetic reluctance material comprises a ferromagnetic material.

7. An antenna, comprising:

a dielectric substrate having first and second opposing surfaces;

a planar radiator disposed along the first surface of the dielectric substrate, the planar radiator being operable to generate a magnetic field;

a ground plane disposed along the second surface of the dielectric substrate;

a magnetic material disposed along the second surface of the dielectric substrate, such that the ground plane is interposed between the magnetic material and the radiator;

wherein:

the radiator is operable to generate a radiation pattern and an associated magnetic field; and the magnetic material operates to confine the magnetic field and to influence magnetic field distribution and radiation pattern in an area about the second surface of the dielectric substrate.

8. The antenna of claim 7, wherein the magnetic material comprises a ferromagnetic material.

9. A communication device, comprising:

communication circuitry;

an antenna coupled to the communication circuitry, the antenna comprising:

a radiator that generates an electromagnetic field having a magnetic field component;

a low magnetic reluctance material positioned in close proximity to the radiator along a particular side of the radiator, and having a primary function of confining the electromagnetic field to reduce radiation generated by the radiator along the particular side of the radiator;

a ground plane disposed between the low magnetic reluctance material and the radiator; and a dielectric substrate disposed between the radiator and the ground plane.

10. The communication device of claim 9, wherein the radiator is a planar patch radiator.

11. The communication device of claim 9, wherein the low magnetic reluctance material comprises a ferromagnetic material.

12. The communication device of claim 9, further comprising an energy dissipative material disposed between the low magnetic reluctance material and the ground plane.

* * * * *